United States Patent [19]

Lizardo et al.

[11] 4,335,166

[45] Jun. 15, 1982

[54] METHOD OF MANUFACTURING A MULTIPLE-PANE INSULATING GLASS UNIT

[75] Inventors: Renato A. Lizardo, Minnetonka; Roger D. O'Shaughnessy, Chaska, both of Minn.

[73] Assignee: Cardinal Insulated Glass Co., Minneapolis, Minn.

[21] Appl. No.: 262,424

[22] Filed: May 11, 1981

[30] Foreign Application Priority Data

Nov. 21, 1980 [DE] Fed. Rep. of Germany ..... 3043973

[51] Int. Cl.[3] ..... E06B 3/24

[52] U.S. Cl. ..... 428/34; 52/172; 52/789; 156/85; 156/99; 156/107; 156/109; 428/45; 428/192

[58] Field of Search ..... 428/34, 45, 192; 156/109, 85, 107, 292, 99; 52/789, 172

[56] References Cited

U.S. PATENT DOCUMENTS

| | | | |
|---|---|---|---|
| 1,988,964 | 1/1935 | Barrows | 52/789 |
| 3,226,903 | 1/1966 | Lillethun | 52/172 |
| 3,473,988 | 10/1969 | Rullier | 428/34 |
| 3,553,913 | 1/1971 | Eisenberg | 52/616 |
| 3,837,129 | 9/1974 | Losell | 428/34 |
| 3,875,706 | 4/1975 | Okawa | 52/172 |
| 3,925,945 | 12/1975 | White | 52/172 |
| 4,004,389 | 1/1977 | DiFazio | 52/789 |

FOREIGN PATENT DOCUMENTS

| | | | |
|---|---|---|---|
| 514785 | 10/1952 | Belgium | 428/34 |
| 638327 | 10/1963 | Belgium | 52/789 |
| 497986 | 9/1954 | Italy . | |

*Primary Examiner*—Ellis P. Robinson
*Attorney, Agent, or Firm*—James R. Haller

[57] ABSTRACT

An insulating unit suitable for installation in walls, doors, and the like, is manufactured by a method that includes the steps of supporting a heat-shrinkable plastic film between spaced but parallel glass panes to provide an integral unit, and then heating the unit to cause the plastic film to shrink and become taut and wrinkle-free.

10 Claims, 5 Drawing Figures

Fig. 1
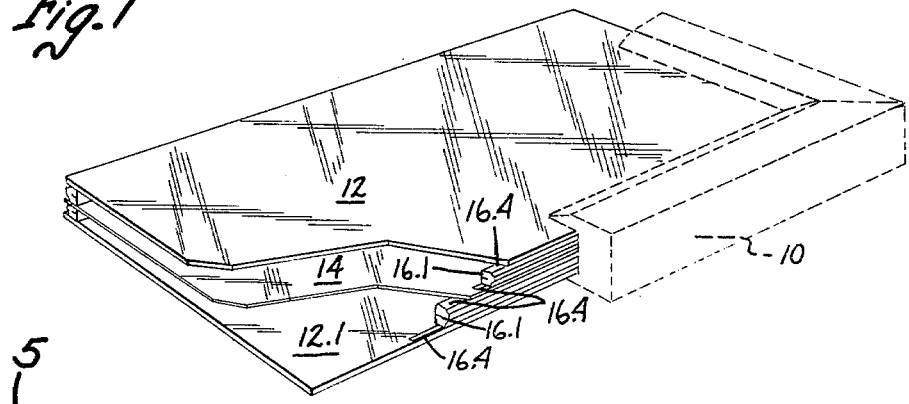
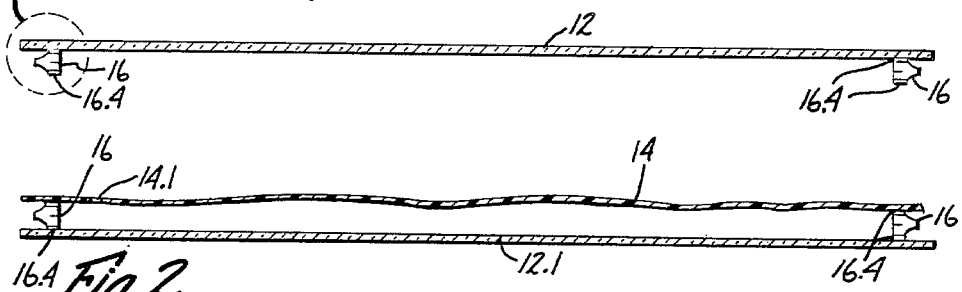
Fig. 2
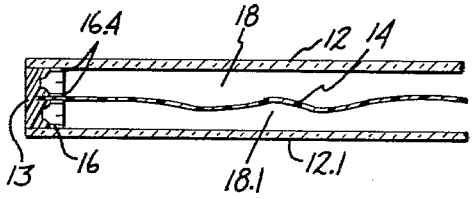
Fig. 3
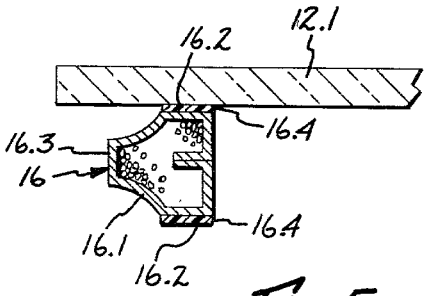
Fig. 5
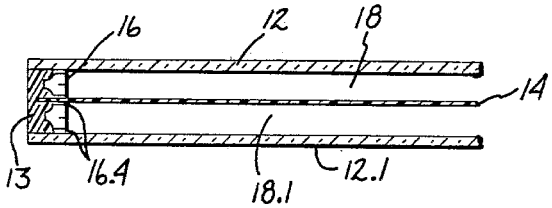
Fig. 4

METHOD OF MANUFACTURING A MULTIPLE-PANE INSULATING GLASS UNIT

TECHNICAL FIELD

The invention relates to the manufacture of insulating glass units for use in windows or in doors or the like.

BACKGROUND ART

Insulating glass units for use in windows or doors or the like commonly comprise two or more parallel glass panes that are separated from one another by spacers along their edges. Various multiple-pane configurations are known to the art, and such configurations may include two, three or more panes. Certain of these configurations have employed sheets of plastic in parallel, spaced relation to the glass panes. If a multiple pane glass unit is to be assembled with a plastic sheet held in spaced relationship between two glass panes, the unit may be manufactured by applying a marginal spacer along the edges of one glass pane, the spacer extending away from the plane of the pane, adherring a heat-shrinkable film to the spacer, and then heat-shrinking the film to draw the film taut and flat. The second pane, also provided with a marginal spacer, is then attached, the film becoming sandwiched between the opposed marginal spacers of the two panes. In another embodiment, the film may be grasped by small springs that are held by or form a part of spacers separating the two glass panes from one another. Generally unbreakable mirrors may be formed by adherring a marginal spacer about the periphery of a sheet of plywood or the like, then adherring a heat-shrinkable, silvered plastic film to the spacers, and then heat-shrinking the film so that it becomes taut and flat to provide a mirrored surface.

In each of the described embodiments employing heat-shrinkable plastic film, the film is stretched over spacers held at the edge of a stiff pane or board or the like, and the plastic film is then heated directly, typically by hot air. For multiple-pane glass units in which the plastic film is to be employed as an internal sheet between but spaced from parallel glass panes, the manufacturing methods cited above have been found difficult and time consuming, and require piece-meal construction methods.

DISCLOSURE OF THE INVENTION

In the present invention, a multiple-pane insulating window unit is manufactured by supporting a flexible, heat-shrinkable plastic sheet between parallel, spaced glass panes, the panes being spaced from one another and from the plastic film by means of spacers arranged about the edges of the glass panes. The panes are substantially sealed to one another along their edges by the spacers and by a sealant adherred to edges of the plastic sheet to provide, with the heat-shrinkable plastic sheet, a substantially sealed integral unit. The unit itself is then heated for a sufficient time and at a sufficient temperature to cause the plastic sheet to shrink and to become taut and wrinkle-free. The resulting integral unit, upon cooling, requires no further manufacturing steps, but rather can be directly inserted into an appropriate frame for use as an insulating glass unit.

BRIEF DESCRIPTION OF DRAWING

FIG. 1 is a perspective view, shown partially broken-away and in partial cross-section, of a window unit resulting from the manufacturing method of the invention;

FIG. 2 is an exploded cross-sectional view showing elements of the window unit ready for assembly;

FIG. 3 is a cross-sectional view similar to that of FIG. 2 but showing the window elements as assembled;

FIG. 4 is a cross-sectional view similar to that of FIG. 3 and showing the window unit after the heating step; and FIG. 5 is an enlarged view of the circled portion of FIG. 2.

BEST MODE FOR CARRYING OUT THE INVENTION

As shown in FIG. 1, the completed window unit resulting from the method of the invention comprises at least a pair of parallel, spaced glass panes (12 and 12.1), and an intermediate plastic sheet (14) that is parallel to the glass panes but spaced inwardly from each pane. The panes are provided with opposing spacers, (16) about their peripheral edges, the spacers supporting the panes in their spaced, parallel relationship to the sheet (14). The sheet (14) may be coated or tinted as desired to provide desired window effects known to the art. Shown in dashed lines and broken-away in FIG. 1 is a frame 10 within which the window unit may be supported for use in a known manner. Frames employed for insulating window units are well-known to the art, and need not be described in greater detail here.

In the manufacturing process of the invention, glass panes (12 and 12.1) are provided and are cut to the same length and width dimensions. To one surface of each of the panes is adherred a spacer (16), the spacer extending generally about the periphery of the pane and spaced inwardly slightly from the pane edge, as shown best in FIG. 5. Each spacer comprises an elongated, roll-formed, generally tubular shape (16.1) (FIG. 5) of aluminum or plastic or other rigid material, the shape desirably having walls (viewed in cross-section) so formed as to provide a substantially hollow interior and flattened, parallel exterior wall portions (16.2). The hollow portion of the tubular shape (16.1) may contain a desiccant (16.3) such as silica gel. The spacer includes adherent strips (16.4) of a sealant material such as polyisobutylene, the latter being capable of withstanding temperatures on the order of 250° F. (121° C.) without substantial deterioration. The adherent strip (16.4) adheres the side wall (16.2) of the tubular shape (16.1) to the surface of the glass pane. The spacer (16) extends about the entire periphery of both panes (12 and 12.1), the hollow interiors of the tubular shapes being employed in known fashion to receive corner keys (not shown) at corners of the panes. The tubular shapes of the type described, and corner keys, desiccants, and strips of sealant are all known to the art, and need not be described further in detail.

A heat-shrinkable plastic sheet (14) is drawn across the spacers (16) carried by one of the panes, and is pulled as taut as may be practical, the sheet coming into contact with the sealant strips (16.4) carried by the tubular shape (16.1) as shown in FIG. 1. The remaining pane, with its peripheral spacer (16), is now oriented with respect to the first pane so that the adherrent strips (16.4) opposite those adherred to the glass panes are in direct opposed relationship, the plastic sheet (14) being captured between the opposing adherrent strips (16.4). The plastic sheet, being somewhat flexible, ordinarily contains waves and wrinkles at this stage, as shown diagramatically and in exagerated form in FIG. 3 of the drawing. A sealant (13) is then applied between the edges of the glass panes which extend outwardly of the spacers (16), such edges forming, with the spacers, a slight depression or trough in the edge of the assembled unit. The edges of the plastic sheet, as shown, extend into the depression. The sealant (13), typically a silicone resin such as the two-part, room-temperature-curing resin identified as GE3204 (manufactured by the General Electric Company) is then cured in place, the resin strongly adherring together the glass panes, the outwardly exposed portions of the spacers and the edges of the plastic sheet to form an integral unit.

Preferably, the plastic sheet is oriented midway between the confronting glass pane surfaces. It will be understood that the plastic sheet, when shrunk, exerts inwardly directed forces on the spacers which in turn cause compressive forces to be exerted on, and in the plane of, the glass panes. By providing the plastic sheet midway between the confronting glass pane surfaces, the compressive load borne by each pane, although slight, is expected to be approximately equal.

The integral unit may then be heated, as by being placed in a forced air oven, for a period sufficient to cause the heat-shrinkable plastic sheet to shrink to the extent necessary to remove substantially all wrinkles or waves in the sheet, the sheet being clamped and held at its edges by the spacers (16) and the sealant (13). The sheet is protected from drafts of hot air or the like by the panes, and sudden or excessive temperature increases ("hot spots") are hence avoided. The unit is then cooled until the plastic sheet temperature is below its softening or "glass" point temperature. The shrunken sheet, in position between the glass panes in the substantially sealed unit, hence is cooled slowly, the glass panes and spacers reducing the cooling rate of the sheet and preventing the sagging of the sheet that could occur if the sheet was cooled suddenly.

During the heating operation, the temperature of air or other gas which may be employed within the spaces (18 and 18.1) is raised to or nearly to the oven temperature, but because of the strength of the seal formed by the spacers (16) and sealant (13), the resulting pressures in the spaces (18, 18.1) are readily resisted. It may be desirable in some instances to install or provide a small channel such as a breather tube (not shown) through one of the spacers, the integral unit remaining substantially sealed. The breather tube serves to communicate the interior of the spaces (18 and 18.1) with the atmosphere, and may be later plugged if desired. The sealant (13) is chosen, as exemplified above, to be resistant to softening or deterioration during the heat-shrinking procedure; that is, the sealant grips the edges of the sheet and permits very little if any movement of the sheet with respect to the panes.

Of importance, means must be provided to enable one of the spaces (18) between the panes and plastic sheet to communicate with the other space (18.1). Such means may take the form of one or more small perforations formed in the plastic sheet adjacent its edges. One such perforation is shown as 14.1 in FIG. 2. Desirably, only a single perforation is employed, such perforation having smooth edges (as results from piercing the sheet with a hot needle to form the perforation by melting) so as to reduce any tendency of the perforation to initiate a tear in the plastic sheet during the heating step.

Various modifications to the preferred embodiment described above will now be evident. For example, the assembly may employ more than two panes of glass, and more than one heat-shrinkable plastic sheet. The heating step, moreover, although preferably carried out in a forced air oven, may be accomplished in other known ways.

Heat-shrinkable plastic sheets or films are known to the art and are commercially available. Such sheets are commonly produced by stretching the sheets in their length and width dimensions at temperatures below the melting point to provide, it is believed, molecular orientation in the sheets. Subsequent heating of the sheets during a shrinking procedure, it is further believed, reduces the molecular orientation, causing the sheets to shrink in length and width dimensions. The preferred plastic is polyethylene terephthalate, a polyester, which is commercially available under the trademark "Melinex" type "OW" by Imperial Chemical Industries. Heat-shrinking temperatures in the range of about 195° C. (90° C.) to about 250° F. (121° C.) have been successfully employed for films of this type. Such sheets may include or bear coatings of various materials, and may be of any practical thickness; thicknesses of about 0.0005 to about 0.006 inches (0.013 to 0.15 mm.) being preferred. It is often desirable to include ultra-violet light absorbers in the sheets to increase their resistance to becoming brittle upon exposure to sunlight. The sheets may be tinted with a dye to provide desirable or pleasing effects. The sheets may be coated on one or both sides with coatings which are highly transmissive of visible light but highly reflective of long wave infrared radiation.

The current manufacture of multiple-pane insulating glass units normally involves the affixation of a spacer to the edges of a pane of glass, following which a second pane of glass is oriented against the spacer, parallel to but spaced from the first pane. The panes of glass normally extend outwardly beyond the spacers a short distance, and the depression or trough thus formed ordinarily is filled with a sealant to seal the entire unit. The instant invention, in which a heat-shrinkable plastic sheet is supported between glass panes by the use of spacers attached to each pane, and then is heated to draw the sheet taut, lends itself readily to existing manufacturing techniques.

While we have described the best mode known for carrying out the invention, it will be understood that various changes, adaptations, and modifications may be made therein without departing from the spirit of the invention and the scope of the appended claims.

What is claimed is:

1. Method of manufacturing a multiple-pane insulating glass assembly characterized by the steps of (a) Forming a substantially sealed integral unit comprising supporting a flexible, heat-shrinkable plastic sheet between parallel, spaced glass panes, the sheet being substantially parallel to but spaced from confronting surfaces of the panes and being fixed at its edges with respect to edges of the panes; and (b) Heating the unit to cause the plastic sheet to shrink and become taut and wrinkle-free between the panes.

2. The method of claim 1 including the step, prior to heating, of providing a sealant between adjacent edges of the panes to provide an integral substantially sealed unit.

3. The method of claim 1 in which the plastic film is positioned midway between confronting surfaces of the glass panes.

4. Method of manufacturing a multiple-pane insulated glass assembly comprising the steps of (a) Providing a pair of glass panes;

(b) Attaching an elongated spacer to one surface of each pane about the periphery of the pane, each spacer having a generally flattened, continuous surface lying in a plane parallel to but spaced from the surface of the pane to which it is attached, and the spacer attached to one pane being congruent to the spacer attached to the other pane;

(c) Supporting between the flattened surfaces of the spacers a heat-shrinkable plastic sheet and providing a sealant between adjacent edges of said panes to provide an integral substantially sealed unit; and (d) Heating the integral unit to cause the heat-shrinkable plastic sheet to shrink and to become taut and wrinkle-free between the glass panes.

5. The method of claim 4 in which the spacers are spaced inwardly slightly from the edges of the glass panes to which they are attached, the spacers defining with the outwardly extending edges of the glass panes a trough into which extends edges of the plastic sheet, the method including the step of incorporating in the trough a hardenable polymeric sealant to seal the edges of the integral unit and to bond to the edges of the plastic sheet, and hardening said sealant prior to said heating step.

6. The method of claim 2 including the step of providing at least one perforation through the plastic sheet prior to said heating step.

7. The method of claim 4 wherein the panes of glass and plastic sheet define spaces therebetween, the method including the step of providing means communicating at least one of said spaces with the atmosphere.

8. Method of manufacturing a multiple-pane insulating glass assembly comprising the steps of:

(a) supporting a flexible, heat-shrinkable plastic sheet between parallel, spaced, glass panes, the panes having confronting spacers about but spaced inwardly of their edges and the sheet extending between the opposed spacers with edges of the sheet extending outwardly from the spacers;

(b) providing a hardenable sealant about the edges of the panes, sheet and spacers;

(c) hardening the sealant to form an integral, substantially sealed unit; and (d) heating the integral unit to cause the heat-shrinkable plastic sheet to shrink and to become taut and wrinkle-free between the glass panes.

9. Method of manufacturing a multiple-pane insulating glass assembly comprising the steps of:

(a) Forming a substantially sealed integral unit comprising a pair of spaced, parallel glass panes and a heat-shrinkable plastic sheet substantially parallel to the panes but spaced equidistant from confronting surfaces of the panes, the sheet being fixed at its edges with respect to edges of the panes;

(b) Heating the unit to cause the plastic sheet to shrink and to become taut and wrinkle-free between the panes, and then cooling the unit, the glass panes protecting the plastic film from temperature extremes during the heating and cooling steps.

10. The multiple-pane insulating glass assembly produced by the method of claim 1.

* * * * *